United States Patent [19]

Samland et al.

[11] Patent Number: 4,913,628

[45] Date of Patent: Apr. 3, 1990

[54] RADIAL PISTON PUMP FOR PUMPING WATER

[75] Inventors: Ulrich Samland, Hattingen; Wolfram Wittkop, Sprockhövel, both of Fed. Rep. of Germany

[73] Assignee: Hauhinco Maschinenfabrik G. Hausherr, Jochums GmbH & Co. KG, Essen, Fed. Rep. of Germany

[21] Appl. No.: 213,637

[22] Filed: Jun. 30; 1988

[30] Foreign Application Priority Data

Jul. 1, 1987 [DE] Fed. Rep. of Germany ..... 3721698

[51] Int. Cl.[4] ..... F04B 1/04

[52] U.S. Cl. ..... 417/273; 417/367; 184/622

[58] Field of Search ..... 417/273, 366, 367, 368, 417/369, 269, 372, 371; 184/6.22, 6.5, 6.6, 13.1; 92/153

[56] References Cited

U.S. PATENT DOCUMENTS

| | | | |
|---|---|---|---|
| 982,632 | 1/1911 | Prather | 417/273 |
| 1,269,909 | 6/1918 | Cooper | 417/366 |
| 2,106,488 | 1/1938 | McCune | 417/203 |
| 2,454,371 | 11/1948 | Berges | 417/366 |
| 2,622,942 | 12/1952 | Munoz | 417/372 |
| 2,734,459 | 2/1956 | Zimsky | 417/367 |
| 3,969,043 | 7/1976 | Bright et al. | 417/366 |
| 4,480,967 | 11/1984 | Schulze | 417/368 |

FOREIGN PATENT DOCUMENTS 2029505 3/1980 United Kingdom .

*Primary Examiner*—Leonard E. Smith
*Assistant Examiner*—Robert N. Blackmon
*Attorney, Agent, or Firm*—Herbert Dubno

[57] ABSTRACT

The radial piston pump for pumping water, especially pure water, comprises a pump housing, a central drive mechanism and a surrounding pump mechanism which has a plurality of piston-and-cylinder units radially oriented and distributed about its circumference. Inlet and outlet valves for individual cylinder chambers are located in the vicinity of the piston-and-cylinder units. The drive mechanism is located in a housing chamber which has an oil sump. The housing chamber is surrounded by a cooling device comprising a plurality of gaps and ducts for conducting water to the inlet valves which are provided with a suction intake fitting for admitting water.

3 Claims, 3 Drawing Sheets

RADIAL PISTON PUMP FOR PUMPING WATER

FIELD OF THE INVENTION

Our present invention relates to a radial piston pump for pumping water, especially pure or clean water.

BACKGROUND OF THE INVENTION

A radial piston pump for pumping water generally comprises a pump housing, a central drive mechanism and a surrounding pumping mechanism which has a plurality of radially oriented piston-and-cylinder units distributed around its circumference. The inlet and outlet valves for the individual cylinder chambers are positioned in the vicinity of the piston-and-cylinder units. Particularly these pumps are high pressure pumps. "Pure water" here means water without added lubricating agents.

In the conventional radial piston pump of the described type and for the described purpose, the drive mechanism runs in the water to be pumped or fed. That has proven satisfactory when the water to be pumped contains a lubricant in sufficient quantities, e.g. a lubricant/water emulsion containing water with about 5% lubricant.

With decreasing lubricant content of the water to be pumped one observes, especially at higher pumping speeds, increasing heat generation and a troublesome heating of the drive mechanism and the entire pump housing. The water containing the lubricant is an environmental contaminant when disposed of after use.

OBJECTS OF THE INVENTION

It is an object of our invention to provide an improved radial piston pump for pumping water which is free from the above mentioned disadvantages or difficulties.

It is another object of our invention to provide an improved radial piston pump for pumping water in which detrimental heating of the drive mechanism and housing cannot occur, even when pure water is being pumped.

SUMMARY OF THE INVENTION

These objects and others which will become more readily apparent hereinafter attained, in accordance with our invention, in a radial piston pump water, especially pure water, comprising a pump housing, a central drive mechanism and a surrounding pump mechanism which has a plurality of radially oriented piston-and-cylinder units distributed over its circumference. The inlet and outlet valves of the individual cylinder chambers are located in the vicinity of the piston-and-cylinder units.

According to our invention the drive mechanism is located in a housing chamber which has an oil sump or pan and the housing chamber is surrounded by a cooling device comprising a plurality of gaps and ducts for conducting the water to the inlet valves.

These gaps and ducts are connected with a suction intake fitting for the pumped water, e.g. a fitting provided with a foot valve or suction valve.

The housing chamber for the drive mechanism is constructed as a closed chamber except for a filling and emptying port. The cooling is particularly intensive when the gaps are located on both sides of the housing chamber for the drive mechanism and the ducts are arrayed to surround the housing chamber, passing axially parallel to one another between the gaps on opposite axial sides of the housing chamber. The ducts can be formed as passages. The housing chamber has at least one chamber-forming wall with at least one cooling rib directed into the gaps for promoting heat transfer from the oil to the water drawn in through the fitting and passing to the intake vales.

Hence, the water pumped simultaneously can fulfill an additional function, namely a cooling function for the drive mechanism.

The drive mechanism itself runs in a lubricant and develops little heat.

The cooling provided by our invention is thus sufficient for all operating conditions of the radial piston pump and is intensive with a high volume flow of the water to be pumped and thus with higher pumping rates. It is not necessary to add a lubricant to the water pumped as has been done heretofore.

The radial piston pump is particularly suitable for pumping pure (lubricant-free) water and also extremely pure water. During operation of the conventional radial piston pump, when heat generation occurs, the lubricant is circulated through a separate cooling device. Such a cooling device is not necessary in the radial piston pump according to our invention.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
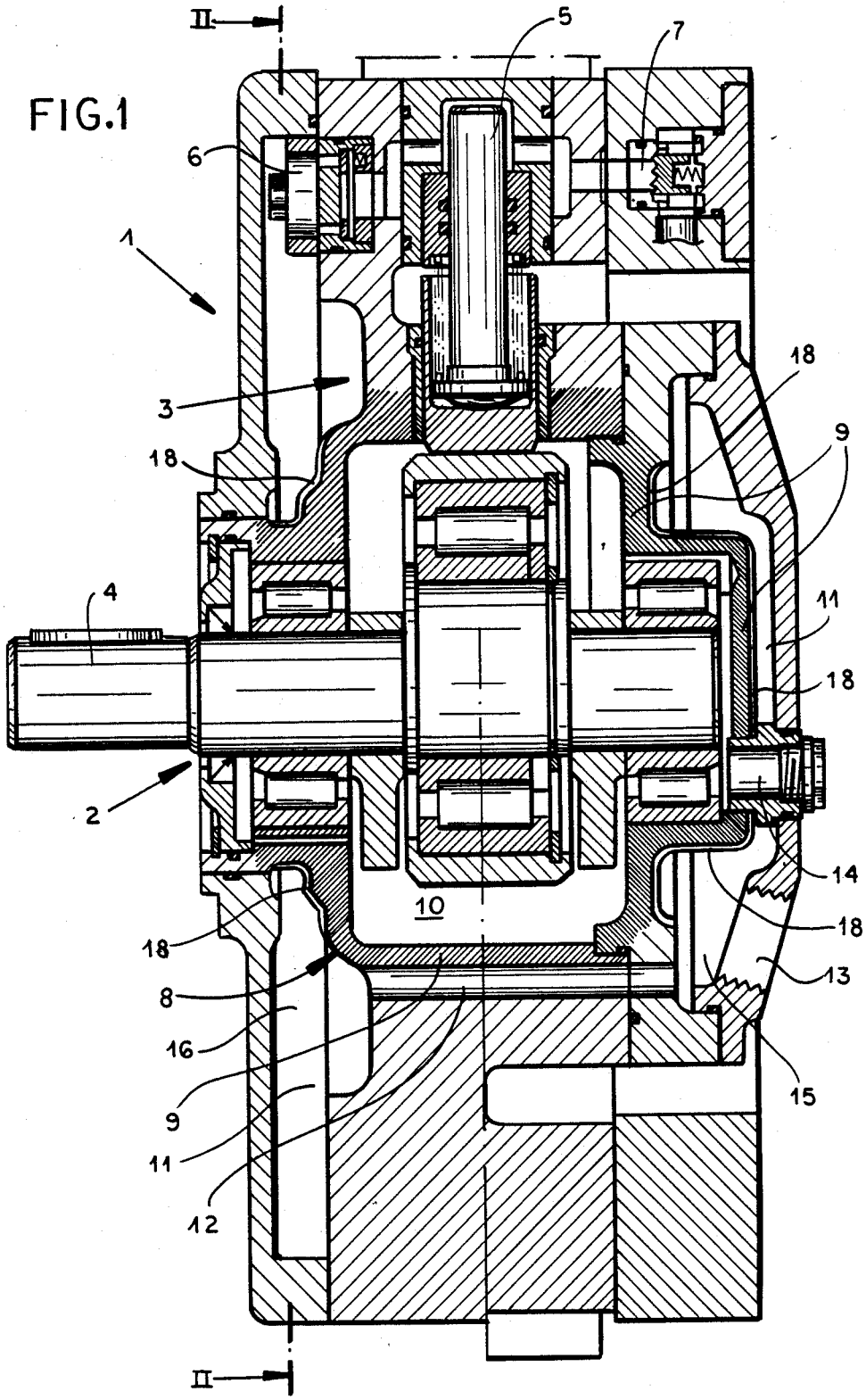
FIG. 1 is an axial cross sectional view of one embodiment of a radial piston pump for water according to our invention.

The radial piston pump shown in the drawing basically comprises a pump housing 1, a central drive mechanism 2 and a surrounding pump mechanism 3. A drive shaft 4 to which a drive in the form of a motor/gear unit is connected is part of the central drive mechanism 2. The drive can be located on the left side of FIG. 1.

Figure 3:
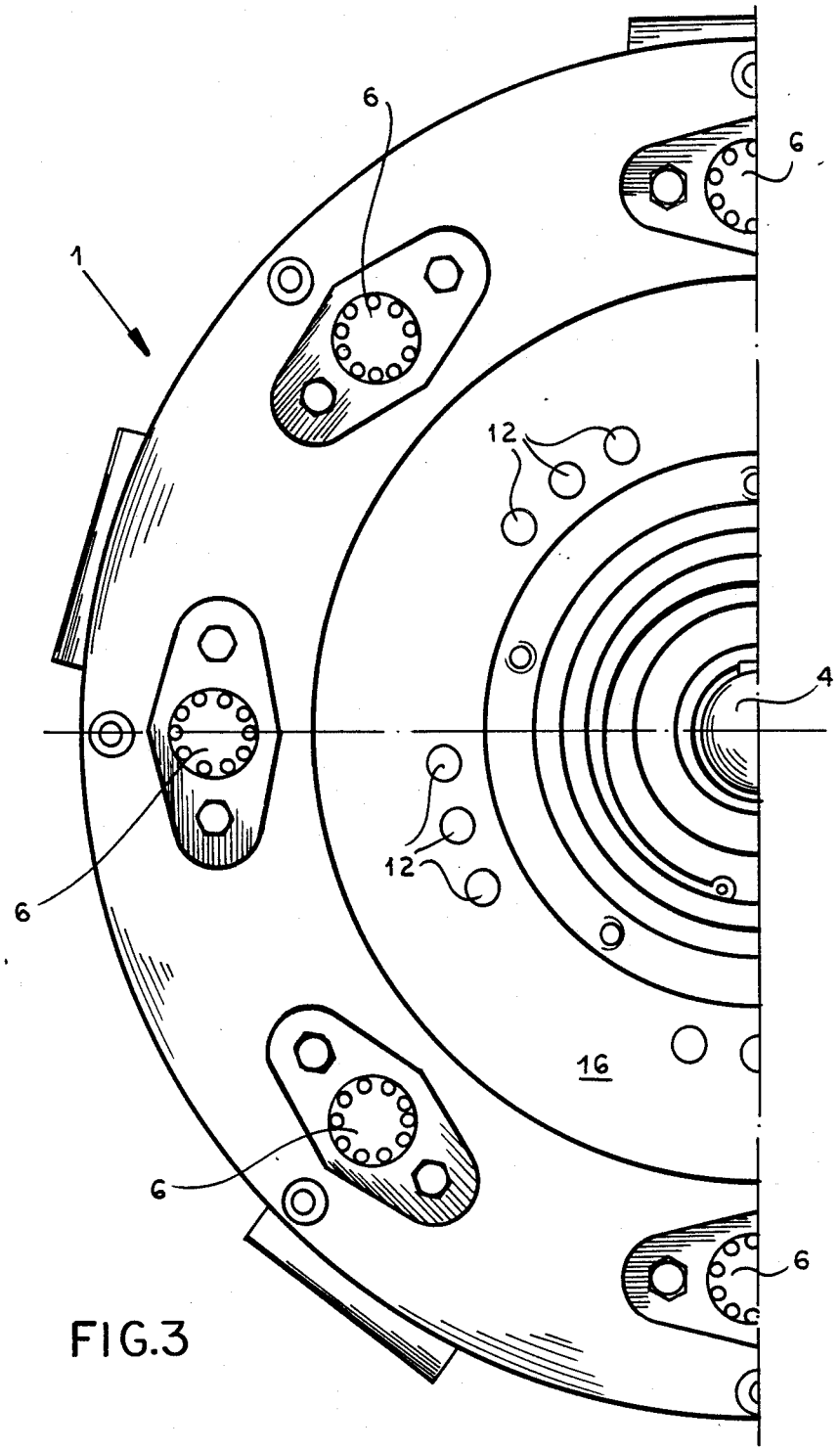
FIG. 3 is a view similar to FIG. 2 through another embodiment of a radial piston pump according to our invention.

The pump mechanism 3 has a plurality of piston-and-cylinder units 5 distributed around the circumference of the pump (FIG. 3). In the vicinity of the piston-and-cylinder units 5 the inlet and outlet valves 6 and/or 7 for the pumped water are located. These vales are positioned to communicate with the respective pumping cylinders at opposite axial sides of the housing provided with the pumping cylinders.

The drive mechanism 2 is mounted in a housing chamber 8 whose chamber-forming walls 9 are indicated in FIG. 1 by closely spaced sectional hatching. This housing chamber 8 has an oil sump 10.

The design is such that the housing chamber 8 is surrounded by a cooling device which comprises a plurality of taps 11 between front and rear axially spaced end walls of the chamber 8 and walls of the pump housing spacedly flanking same, and ducts 12 (which extend parallel to the axis, surround the chamber 8 and connect the gaps 11) for conducting the pumped water to the inlet valves 6 (which communicate with one of the gaps 11). The gaps and passages 11, 12 are provided with a suitable suction intake fitting 13 for the water which is located as centrally as possible. The housing chamber 8 for the drive mechanism 2 in this embodiment is advantageously formed as a closed chamber except for a filling and emptying port 14 for the lubricating medium. The gaps 11 are located on both sides of the housing chamber 8 for the drive mechanism 2. The ducts 12 are distributed over the circumference or periphery in the valve body surrounding chamber 8 and located substantially parallel to the drive shaft 4. They are formed as passages. The ducts 12 extend from the distributor chamber 15 at one gap 11 open into the collector chamber at the other gap 11 and at which the pump cylinders communicate via the intake fittings 13.

From FIG. 1 it will be apparent that it is possible to provide the chamber-forming walls 9 of the housing chamber 8 with cooling ribs 18 directed into the gaps 11.

Figure 2:
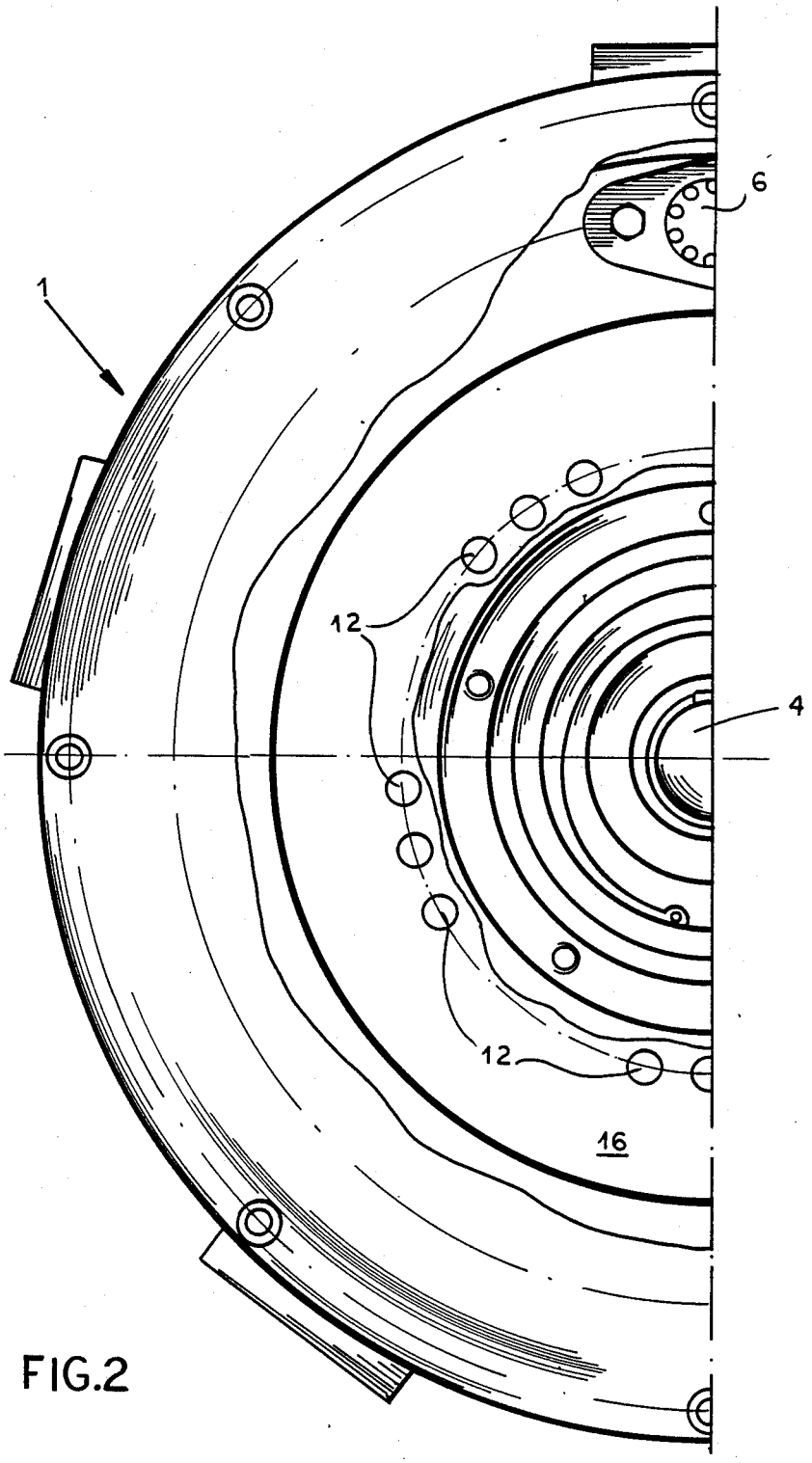
FIG. 2 is a cross sectional view taken along the section line II—II of FIG. 1.

In the embodiment shown in FIG. 3 a plurality of inlet valves 6 are indicated corresponding to the plurality of piston-and-cylinder units 5 in the main embodiment presented here. In the embodiment shown in FIG. 2 which is similar, only one inlet valve 6 is shown corresponding to a single piston-cylinder device 5. The embodiment of FIG. 3 has the same structure as indicated in FIG. 1 except that there are a plurality of piston-and-cylinder units 5 correspondingly distributed circumferentially.

We claim:

1. A radial piston pump for pumping water, comprising:

means forming a closed chamber having a single fitting enabling the introduction of a lubricant into and draining of the lubricant from said chamber, said chamber having a pair of axially spaced end walls;

a pump body peripherally surrounding said chamber and formed with at least one radially oriented piston-and-cylinder pumping unit having an intake valve at one axial side of said body and an outlet valve at an opposite axial side of said body;

a pump housing having axially spaced end walls juxtaposed with said end walls of said chamber and said sides of said body, said end walls of said housing defining with said end walls of said chamber a pair of axially spaced gaps with one of said gaps communicating with said intake valve, said body being formed with a plurality of passages parallel to an axis of said chamber, communicating between said gaps and arrayed around said chamber, said housing being formed with a suction intake fitting communicating with said gaps and said passages for delivering water to said intake valve, whereby said water passes in heat exchanging relationship with said lubricant through said end walls and said periphery of said chamber; and a drive mechanism for said unit having a shaft extending axially into said chamber and provided within said chamber with means immersed in said lubricant for actuating said unit.

2. The radial piston pump defined in claim 1 wherein said end walls of said chamber are provided with heat-exchange promoting ribs formed on said end walls of said chamber and projecting into said gaps.

3. The radial piston pump defined in claim 2 wherein said valve body is formed with a plurality of said piston-and-cylinder pumping units each having an intake valve at said one axial side of said body and an outlet valve at said opposite axial side of said body, all of said units being driven by said drive mechanism, all of said intake valves communicating with said one of said gaps.

* * * * *